United States Patent [19]

Künzler

[11] Patent Number: 5,012,758

[45] Date of Patent: May 7, 1991

[54] METHOD AND APPARATUS FOR THE TREATMENT OF GLIDING SURFACES ON WINTER SPORTS EQUIPMENT

[75] Inventor: Peter Künzler, Altstatten, Switzerland

[73] Assignee: Tobler & Co. AG, Chemische Fabrik, Altstatten, Switzerland

[21] Appl. No.: 316,837

[22] Filed: Feb. 28, 1989

[30] Foreign Application Priority Data

Mar. 1, 1988 [CH] Switzerland ..... 761/88

[51] Int. Cl.[5] ..... B05C 11/00

[52] U.S. Cl. ..... 118/264; 118/72; 118/263; 118/258; 118/256; 118/242; 118/243; 118/244

[58] Field of Search ..... 427/314, 384, 11; 118/264, 271, 72, 256, 263, 258, 242, 243, 244; 15/231; 134/19

[56] References Cited

U.S. PATENT DOCUMENTS

| | | | |
|---|---|---|---|
| 2,537,511 | 1/1951 | Collombe | 118/72 X |
| 3,045,639 | 7/1962 | Kurlander et al. | 118/271 X |
| 3,136,659 | 6/1964 | Walker et al. | 118/72 X |
| 3,425,394 | 2/1969 | Rey | 118/72 X |
| 3,641,612 | 2/1972 | Clurman et al. | 15/231 |
| 4,407,218 | 10/1983 | Ordas | 118/72 X |
| 4,457,255 | 7/1984 | Amann | 118/242 X |
| 4,860,688 | 8/1989 | Nazzarro | 118/410 X |

*Primary Examiner*—Shrive Beck
*Assistant Examiner*—Alain Bashore
*Attorney, Agent, or Firm*—Sughrue, Mion, Zinn, Macpeak and Seas

[57] ABSTRACT

Skis are waxed by a heated sole plate 18 with a porous insert 42 which is flexibly applied to the gliding surface and can be shifted in a longitudinal direction. The insert absorbs wax 50 from a tub 48 heated to a pasty consistency. Porous sheet material 46 may be applied between the sole and the gliding surface. The treatment can include the removal of remnants of old wax from the gliding surface, which is absorbed by the sheet material and softened by heating the gliding surface with the sole. The wax penetrates into the micro cavities of the ski bottom coating and any scratches in it, and the sheet material ensures that a smooth, flat and flexible layer is formed on the gliding surface.

9 Claims, 1 Drawing Sheet

METHOD AND APPARATUS FOR THE TREATMENT OF GLIDING SURFACES ON WINTER SPORTS EQUIPMENT

BACKGROUND OF THE INVENTION

This invention concerns a method and apparatus for the treatment of gliding surfaces on winter sports equipment.

In order to optimally use winter sports equipment such as downhill, cross country and jumping skis, ski-bobs, monoskis, snowboards and sled-like equipment with runners, it is necessary to adapt the properties of their gliding surfaces, i.e., their gliding capability, to the respective needs of the users as well as to the snow conditions. Generally the aim is to increase the gliding capability, particularly when the equipment is used competitively, but in certain cases it may also be desirable to reduce the gliding capability, for example when using skis for climbing a mountain or by beginners, or for the attachment of skins.

The adapting of the gliding capacity is done by the application of a wax coating that firmly clings to the gliding surface of the equipment, in most cases containing primarily olefins and which is produced and sold in many variations.

Another purpose of treating the gliding surfaces is to protect the coating applied by the manufacturer. On winter sports equipment of higher quality these coatings consist of high-molecular sintered synthetic materials which, however, without care are subject to aging and embrittlement. This can be prevented at least in part by filling the micro cavities of these synthetic materials with wax. Apart from the protective effect, this creates small reservoirs which empty during gliding, and the clinging of the material is improved.

This wax layer has to be applied to the gliding surface of the equipment in such a manner that it clings tightly to it, and produces a completely flat and flexible running surface.

The waxing of skis has been known for at least 100 years. Originally the wax was applied to the wood or painted gliding surfaces by rubbing a hard block of wax against them. This system is still used today by excursion skiers. However, the wax coatings produced in this manner are not very smooth and also do not cling particularly well. An improvement is attained when warmed or melted wax is applied, which better penetrates the micro cavities and scratches of the gliding surfaces and also can be more evenly distributed to form a flat and smooth surface. For this purpose all types of devices with a flat sole are used, generally called ski irons and which can be heated by means of alcohol, Meta, gas or electricity. They are used for smoothing an existing wax coating, or for applying hard but warmed or liquid wax, which is then smoothed at the same time. Although these irons are not very convenient and in part quite dangerous due to the fuel used, whereby they do not provide sufficiently smooth surfaces and have to be cleaned after every application, winter sports away from mass tourism still depends on them. However, for winter sports near mountain railroads and heavily used trails, as well as for competitive winter sports, various possibilities have been explored for solving the ski waxing problems by means of stationary devices which can apply a wax coating rapidly and without danger, so that it penetrates the surface, adheres well and provides a completely flat and smooth running surface.

It is known, for example, to apply liquid wax to skis from a heated wax tub by means of a continuous belt or roller, whereby the lower side of the belt or roller half runs through the wax tub while the upper side applies the collected wax to the skis. This method is used in ski shops, and has the advantage that the skier with the skis on his feet can move over a wax tub and have his skis waxed in a comfortable manner. However, their disadvantage is that the wax application is not sufficiently smooth and that the tips of the skis generally do not receive a wax application. In addition, the temperature of the applied wax is too low, as it cools on the belt or roller so that it does not penetrate the coating.

In other procedures the skis are mounted in a clamping device with their gliding surfaces facing upwardly, and the wax is applied with a brush or the like. This results in a good adhesion of the wax due to its high temperature, but the smoothness of the surface is not satisfactory. Even in a semiautomatic device, which eliminates the irregularity of manual work, there is always the problem during the back and forth motion of the applicator tool that too little or too much wax is applied, particularly in the end areas, and it is also very difficult to wax the ski tips.

It has also been tried to apply a wax layer to an adhesive tape, which is then applied to the bottom of the ski and pulled off. These tapes are very handy, but the warming of the wax is omitted. There is also the danger that the wax layer will become loose on the ski, for example if it is damaged by rocks, which can lead to severe accidents.

For this reason it has been attempted to provide a carrier tape with a wax layer, to apply it with its waxy side on the gliding surface of a ski, and to heat the tape with an iron such that the wax adheres to the ski and the carrier tape could be pulled off. While this does not avoid the dangerous handling of fuels for heating the iron, its sole does not contact the wax and thus remains clean and can be immediately reused for other skiers and for other wax types. Unfortunately, with this method the full wax layer becomes loose because it is highly heated on its outer side, but much too little on the ski side, so that it will not adhere very well to the ski.

In order to obtain good adhesion as well as a smooth surface, it has been tried to iron wax onto the gliding surface through plates with a large number of very small holes, e.g., tightly meshed grates or sieves. With this fine distribution of the wax a well adhering and sufficiently smooth surface is obtained, but the sole of the iron becomes soiled and has to be cleaned repeatedly, which always interrupts the waxing process.

It has also been tried to iron wax impregnated ribbons, e.g., made of fabric or paper, onto the gliding surface and to then remove the fabric or paper; in this manner good results are obtained with regard to surface smoothness and adhesion, but again the sole of the iron becomes soiled and the iron has to be repeatedly cleaned.

More recently it has been attempted to spray the skis with pulverized wax or with liquid wax from a type of spray gun. The advantage is that there is rapid drying so that a smooth surface is obtained even if the skis are treated when they are in a slanted, almost vertical position. The device for clamping the skis also needs much less space. A disadvantage, however, is that a suction system has to be installed in order to prevent health-damaging effects.

Another problem for waxing is due to the fact that often wet or cold sports equipment has to be treated. However, low temperatures make the application of a sufficiently smooth coating impossible. For this reason the skis have to warm up, so that they have to remain in the service station for some time, which results in an undesirable delay for the user.

Not only the application of wax coatings, for which no fully satisfactory procedure is known so far, but also the removal of old wax coatings or remnants provides difficulties. A purely mechanical scratching off is time consuming and may damage the ski coating. The heating of the wax so that it can be more easily removed by sliding or wiping it off, also has problems. First of all, it is possible that the ski could be heated too much and thus subjected to damage. Secondly, the heating, depending on the procedure and type of fuel, can be dangerous. Thirdly, noxious vapors or gases are produced when the wax decomposes under the influence of heat.

SUMMARY OF THE INVENTION

As neither the problem of the application of wax coatings nor that of the removal of wax coatings or remnants has been satisfactorily solved, an object of the invention is to provide a method and apparatus which is suitable for the rapid and safe application of well adhering waxes, even of varying quality, which penetrate into the micro cavities of the coating, form flat and smooth running surfaces, for the drying and pre-warming of skis immediately after use and before rewaxing, as well as for the removal of wax layers or remnants in a manner that is safe for the skis and environmentally sound. With the invention it is possible to dry, preheat, wax and dewax gliding surfaces of winter sports equipment, particularly skis.

The adhesion of the coating to the gliding surface is very good as the substance remains liquid due to the high temperature of the sole, and only solidifies again on the gliding surface whereat it penetrates into the coating and fills its micro cavities as well as any damaged areas. The resulting surface of the coating substance, which is the actually used surface of the sports equipment, becomes flat, smooth and free of pores. The coating follows the gliding surface shape and does not have any tendency to fill a center groove, if present. Due to the tight contact of the flexible and adjustably mounted sole, even to bent parts of the gliding surface, it is even possible to provide the ski tips with a sufficient coating.

The substance to be applied, generally a wax, can be continuously fed to the sole during the sliding of the sole across the gliding surface. However, it is more advantageous to provide the lower side of the sole with a porous insert which holds the substance, heated at least to a pasty consistency in a tub, into which the sole is fully or partially dipped.

The wax in the tub can also be cold, i.e. solid, with the hot sole liquefying a part of the wax on dipping into it, so that the porous insert of the sole takes on a sufficient wax supply. It is also possible to provide the tub with a heating device in order to heat the wax at least to a pasty consistency, in which form it is then taken up by the insert.

The substance can also be supplied by using a sheet material that is saturated with it, which is brought between the sliding surface and the sole and from which it is extracted by the heat provided by the sole and applied to the gliding surface. The porous insert then mainly serves for holding excess substance.

The insert preferably consists mainly of sintered material. It extends across the whole width of the sole and over part of its length. The sole is advantageously stripped of excess substance after dipping by means of a stripping device arranged on the edge of the tub, so that only a sufficient amount of the substance remains in the insert. This prevents the substance from burning or solidifying on the sole, and thus soiling it and impairing its smoothness which, without recleaning, would have a negative effect on the quality of the coating to be applied, at least with the subsequent application of the substance.

The tub can be designed and arranged in such a manner that it can easily be exchanged for a tub with another type of substance. It is also possible to arrange several tubs with different substances behind each other.

Instead of taking up the medium from a fixed tub by means of the porous insert and applying it to the gliding surface, it is also possible to feed it to the insert from a mobile storage container attached to the body and heated. Here too it is possible to mount several storage containers with various types of substances next to each other and to use them alternatively.

For the application and removal of the substance it is possible to use the same or different types of sheet material. It is advantageous to use paper sheets, but it is also possible to use non-woven material, fabric or knits.

It is important that for the application of the substance a porous sheet material is used. For the removal of the substance it would be more suitable if only the side of the sheet facing the gliding surface would hold the substance, while the side of the sheet facing the sole would be impermeable, in order to prevent the soiling of the sole. On the other hand, it would simplify the procedure if only one type of sheet is used. Depending on the width of the gliding surface to be coated, sheets of various widths can be selected. However they should slightly protrude beyond the gliding surface so that it is securely covered all over and no substance runs down on the sides of the gliding surfaces. It is best to use sheet material that holds together so that no fibers or the like become detached as they could contaminate the wax and the production of a smooth layer would no longer be possible.

It is possible to cover the whole gliding surface with a strip of the sheet material and slide over it with the sole of the body, or only a segment of the sheet material can be used with about the same dimensions as the sole surface and which moves under the sole and simultaneously with it across the gliding surface.

The use of a strip is good in particular for the removal of the layer, as in this manner a larger amount of the substance can be absorbed. The use of a segment is advisable primarily for the application of the substance as the aim is then to obtain a fine distribution of the substance. For this purpose the segment is sufficient and the use of a longer strip would unnecessarily entail a greater use of substance, as in the end the whole strip would be soaked with the substance. However, when using a segment under the sole care should be taken that no sheet material is pulled along behind the sole as it would reabsorb at least a part of the just applied substance. In addition, this would smear the usable surface and it would not be sufficiently smooth.

If the strip shaped sheet material is used, which is placed across the whole gliding surface, it is advisable that it be supplied from a roll attached to the movable part of a shifting device. Such a roll can also be used if only segments of the sheet material are used; the segments can, however, also be taken from a storage case. This would also be possible for using strips of the material, but less handy.

Although in general it is desirable to obtain a smooth gliding surface, there are certain types of snow on which higher speeds can be attained if the gliding surface is slightly structured or irregular. This can be provided by treating it, after the application of the wax, with a suitable device, for example a brush device or a structure roller.

With certain types of snow the best results are obtained if only the micro cavities of the coating on the sliding surface are filled with wax, but otherwise no covering layer is applied. For this purpose the gliding surface is treated as usual, but the covering layer is then removed, for example, by means of brushes.

The lateral borders of the gliding surfaces are generally formed by edge strips of a harder material, generally of metal. These strips are mounted in such a manner that the complete gliding surface, i.e., the coating and the lowest surface of the strips form a continuous surface. When using the winter sports equipment on icy snow or with little snow and protruding rocks and roots, these strips are naturally worn down so that they have to be subjected from time to time to refinishing. For this purpose the new device can be supplemented with an edge strip refinishing device. It can be designed as part of the treatment device and either be effective simultaneously with the application of the layer or subsequent to it. In general this is a milling, filing or grinding device.

Wet and cold gliding surfaces are advantageously dried and prewarmed before the application of the substance. Although the insert in the sole is not needed for this purpose, and a body with a sole without this insert could be used, it is operationally simpler to also use the sole with the porous insert for the drying and preheating. This saves the refitting of the various bodies. The use of sheet material as an intermediate layer can be omitted in the treatment of new skis as there are no remnants of formerly applied material to be absorbed. On used winter sports equipment, however, there are presumably always remnants of earlier applied substances on the gliding surface and it is advisable, for the protection of the sole, to use the sheet material even if the gliding surface should only be dried and preheated.

In general the winter sports equipment is held by a fixed clamping device, while the treatment device, i.e., the body with the sole, is designed in a mobile manner such that it can move along and vertical to the gliding surface. The fixed clamping device is firmly connected to the stationary part of the shifting device, generally with a guide rail. The mobile treatment device is attached to the mobile part of the shifting device. This mobile part has rollers which run on the guide rail. The drive for the reversible lengthwise shifting of the sole and glide surface is done manually or mechanically. The speed of this shifting influences the amount of applied substance and the quality of the adhesion. The device can be improved by a temperature sensor moving over the gliding surface and controlling the speed of the movement through a mechanical drive.

The adjustment device makes it possible to alter the distance between the body with the sole and the gliding surface in a vertical direction such that the sole is in tight contact with the gliding surface during the application of the substance, while it is then lifted off for the return motion. The body with the sole also has to be lowered for dipping into the tub.

The device is generally designed in such a manner that the winter sports equipment is held firm in a lengthwise as well as in a vertical direction while the body with sole can be vertically and lengthwise moved. However, there are numerous other possibilities for the design of the device. For example, the winter sports equipment can be arranged to be shiftable lengthwise, but fixed in height, while the body with sole can only be adjusted in its height. It is also conceivable that the body with the sole is held firm and only the winter sports equipment installed in a lengthwise and vertically shiftable manner.

The adjustment device can be designed in various manners but the sole must be in flexible contact with the gliding surface for the purpose of adjusting to an inexact position of the winter sports equipment in the holding device or a slanted surface on the winter sports equipment. This is attained by means of a mechanical or fluid spring device.

It is also essential that the body which carries the sole is coupled to the adjustment device in a fully mobile manner, for example, by means of a ball joint. In this way the sole has no problem following the gliding surface, even if the latter is slanted or has bent parts such as ski tips.

DETAILED DESCRIPTION OF THE PREFERRED EMBODIMENT

Figure 1:
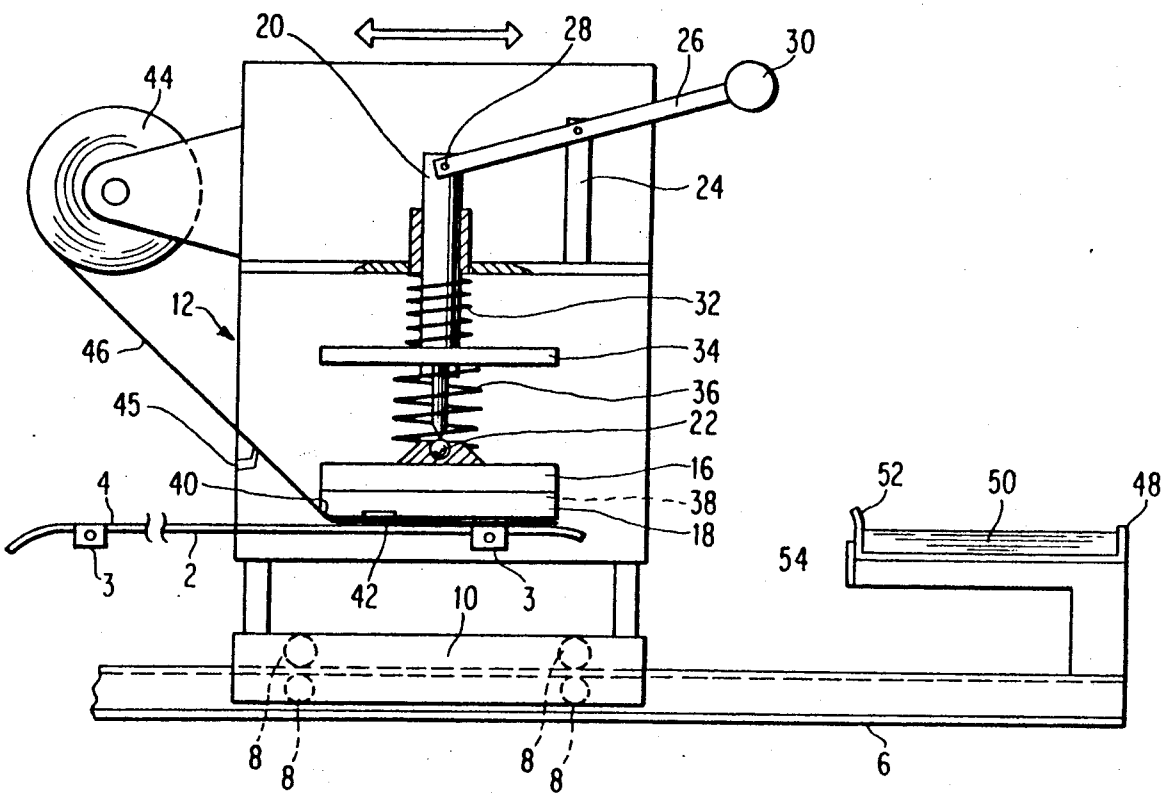
FIG. 1 shows an elevation, in partial section, of an apparatus according to the invention for dewaxing, drying, preheating and waxing skis.

FIG. 1 shows a ski(s) 2 which is clamped, with its gliding surface 4 upward, in a conventional holding device 3, not shown in detail. Such holding devices can be designed as single or double vises, but it is also possible to use a fluid operated clamping device. The ski tip is preferably on the left, as it is also possible for the mounting of bindings, so that the ski will only have to be turned along its longitudinal axis if the gliding surface is to be treated subsequently.

Figure 2:
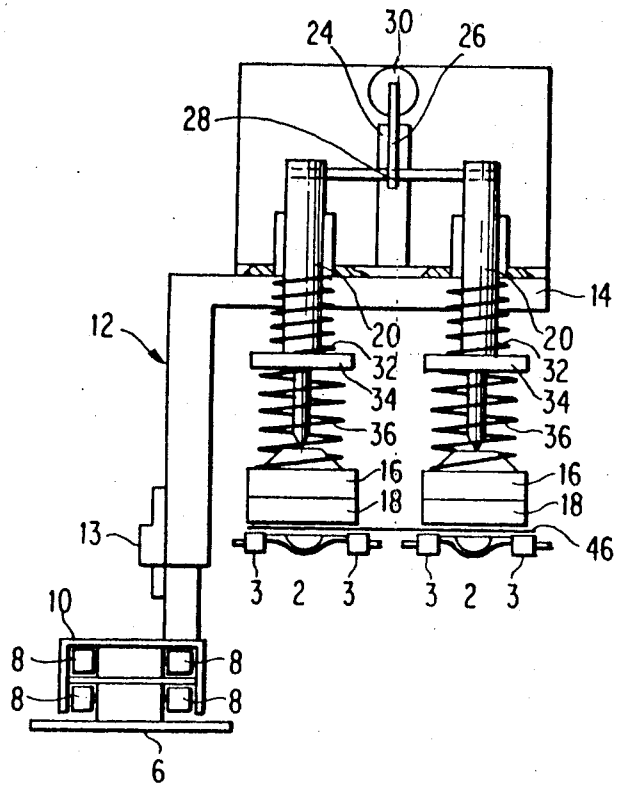
FIG. 2 shows a front view of the apparatus in FIG. 1, seen from the tips of the skis.

The shifting device has a fixed guide rail 6, along which at least four rollers 8 are movable. The longitudinal axes of the clamped ski 2 and the guide rail 4 are parallel to each other. On a cover or housing 10 of the rollers 8 a carrier 12 is mounted, the cross section of which is essentially L-shaped as shown in FIG. 2. On its horizontal leg 14 one body 16 with a sole 18 per ski is mounted in a vertically adjustable manner. The bodies 16 and sole 18 are rectangularly shaped and are made of a copper alloy or the like with good heat conductivity.

For adjusting the body and the sole vertical telescoping rods 20 are mounted in the leg 14 in a height adjustable manner. At the lower end of these rods 20 the bodies 16 are suspended by ball bearings 22 such that they are pivotable in all directions. The horizontal leg 14 has a post 24 on which a lever 26 is pivotably mounted. One end of the lever is connected through joints 28 to the upper part of the rods 20, its other end has a handle 30. A first spring 32 is provided between the horizontal leg 14 and a plate 34 arranged on the rod 20, and a second spring 36 is provided between the body 16 and the plate 34. The rod 20, lever 26 and springs 32 and 36 form the adjustment device for the body 16 with the sole 18.

To treat the gliding surfaces each of the bodies 16 can be heated by means of a heating device 38 in such a manner that the entire sole 18 can be heated to a selectable temperature which is uniform across its surface. The heating device may embody a thermostatic control for limiting its maximum temperature. The edge 40 of the sole 18, shown to the left in FIG. 1, is rounded or slanted.

The sole 18 carries an insert 42 which extends across its whole width and is made of a porous, usually sintered material. A roller 44 is mounted on the carrier 12 in a pivotable and easily replaceable manner, from which porous sheet material 46 can be drawn off in a web or strip and cut by means 45.

A tub 48 is arranged on the end of the guide rail 6, to the right in FIG. 1, and contains the substance (wax) for treating the gliding surface 4. The tub 48 is easily exchangeable so that the type of substance can easily be changed. The left edge of the tub 48 has a flexible stripping device 52, which could also be attached to the holder 54 of the tub 48.

The carrier 12 can pivot about an axis 13 parallel to the guide rail and shown in FIG. 2 so that the skis can easily be clamped in; seen in FIG. 2 it will pivot to the left, in FIG. 1 backwards.

The operation of the apparatus is described below based on a complete treatment, including the removal of old substance with simultaneous drying of the gliding surface, a preheating of the gliding surface and the application of new substance onto the gliding surface.

Before the treatment the carrier 12 and the parts connected to it are flipped backwards (seen in FIG. 1), so that the skis 2 can easily be mounted in the clamping device. The sole 18 and the tub 48 are heated. The carrier 12 and the parts attached to it are then brought back into their operating position, and from the roller 44 a length of sheet material 46 is pulled off to cover the full sole 18. By activating the lever 26 the sole 18 is lowered to the gliding surface 4 and brought into contact under a slight pressure. Due to the ball joint 22 and spring 36 the sole 18 is always in tight contact with the gliding surface 4, even if the parts are not disposed exactly horizontally. The heat which is transferred from the sole 18 to the gliding surface 4 now heats the layer or remnants thereof still adhering to the gliding surface to at least a pasty consistency, and the sheet material 46 absorbs these remnants. During this process the gliding surface 4 is also dried. The sole 18 is now lifted and the whole apparatus shifted to the right. The used up sheet material 46 is removed and the sole 18 is run once or more across the gliding surface to preheat it for the application of the substance, if necessary. By pivoting the lever 26 upwards, using handle 30, the sole 18 is dipped into the heated tub 48, and the insert 42 absorbs a certain amount of substance 50. The sole 18 is then lifted slightly above the rim of the tub 48 and shifted horizontally to the left, whereby the stripping device 52 removes excess substance from the sole 18. Next a section of sheet material 46 corresponding to the surface area of the sole is optionally pulled off the roller 44 and applied to the bottom of the sole. To apply the substance the sole 18 is again brought into contact with the gliding surface 4 and pushed over it. In the area of the ski tip it has to be lowered somewhat so that a sufficient amount of substance is applied to the tip. This concludes the treatment of the gliding surface. The apparatus is now again shifted towards the right and pivoted into its rest position, and the treated skis removed from the clamping device.

For treating other winter sports devices other clamping devices and other bodies and plates are needed. For this reason it is advantageous to design them interchangeably.

In the execution of the procedure with the aid of the device good results were obtained with a wax material that consisted essentially of a mixture of carbohydrates and to which, as needed, slide promoting substances, e.g., graphite or other pigments were added. The sole was heated to a temperature of approximately 130° C.; this temperature is, on the one hand, high enough to assure hot application of the wax, which is sufficient for its penetration into the micro cavities of the coating and for producing a well adhering and smooth layer. On the other hand, this temperature is low enough to prevent damaging the coating, deteriorating or oxidizing the wax, or oxidizing the edges.

What is claimed is:

1. An apparatus for the treatment of gliding surfaces of winter sports equipment, comprising: a treatment device (12) for the gliding surface, clamping means (3) for holding the sports equipment with its gliding surface facing upwardly, carriage means mounting the treatment device, including a shifting device comprising a fixed part (6) and a mobile part (8, 10) for shifting the treatment device and the sports equipment relative to each other in a longitudinal direction of the gliding surface, a storage device (48) for holding a substance to be fed into the treatment device, wherein the treatment device has a body (16) with a heatable sole (18) arranged parallel to the gliding surface, an insert (42) extending across the width of the sole and consisting of a porous material for absorbing the substance from the storage device, an adjustment device (26) for shifting the body and sole vertical to the gliding surface, means (32, 34) for biasing the body and sole downwardly against the gliding surface, and roll means (44) for storing and feeding absorbent sheet material (46) between the gliding surface and the sole to implement the removal of a previous substance coating the gliding surface and the application of a coating of new substance thereto.

2. Apparatus according to claim 1, wherein the clamping means and the fixed part of the shifting device are firmly connected, and the treatment device and the adjustment device are arranged on the mobile part of the shifting device.

3. Apparatus according to claim 1, wherein the fixed part of the shifting device has a rail running parallel to the gliding surface, and the mobile part of the shifting device has rollers running on the rail.

4. Apparatus according to claim 1, wherein the adjustment device has a spring arrangement to provide a flexible contact between the sole and the gliding surface.

5. Apparatus according to claim 1, wherein the adjustment device has a lever device which is linked at a fixed distance from the gliding surface, one end of which is connected by a joint (28) to a suspension device (20) for the body and the other end (30) of which can be manually operated.

6. Apparatus according to claim 1, wherein the body is linked to the adjustment device by a ball joint suspension (22).

7. Apparatus according to claim 1, wherein the storage device is a fixed bowl disposed in a continuation of the gliding surface, into which at least the porous insert of the sole of the body can be dipped by means of the adjustment device, in order to serve as a supply device for the substance.

8. Apparatus according to claim 1, wherein the roll means includes a cutting device (45) for the sheet material.

9. Apparatus according to claim 1, wherein the roll means is attached to the treatment device.

* * * * *